United States Patent [19]

Shapiro et al.

[11] Patent Number: 5,001,492

[45] Date of Patent: Mar. 19, 1991

[54] PLURAL LAYER CO-PLANAR WAVEGUIDE COUPLING SYSTEM FOR FEEDING A PATCH RADIATOR ARRAY

[75] Inventors: Sanford S. Shapiro, Canoga Park, Calif.; William N. Klimczak, Bowie, Md.; Mon. N. Wong, Torrance; Clinton W. Pederson, South El Monte, both of Calif.

[73] Assignee: Hughes Aircraft Company, Los Angeles, Calif.

[21] Appl. No.: 255,218

[22] Filed: Oct. 11, 1988

[51] Int. Cl.[5] ..... H01Q 13/08; H01P 5/18

[52] U.S. Cl. ..... 343/700 MS; 343/853; 333/116; 333/117

[58] Field of Search ..... 333/116, 117, 120, 125, 333/128, 136, 246; 343/700 MS, 846, 848, 849, 853; 342/371, 373, 372

[56] References Cited

U.S. PATENT DOCUMENTS

| | | | |
|---|---|---|---|
| 3,012,210 | 12/1961 | Nigg | 333/116 |
| 3,626,332 | 12/1971 | Barbatoe | 333/116 |
| 4,375,053 | 2/1983 | Viola et al. | 333/116 |
| 4,583,061 | 4/1986 | O'Shea | 333/116 |
| 4,623,893 | 11/1986 | Sabban | 343/700 MS File |
| 4,737,740 | 4/1988 | Millican et al. | 333/116 |
| 4,761,654 | 8/1988 | Zaghloul | 343/700 MS |
| 4,882,555 | 11/1989 | Wong | 333/116 |

FOREIGN PATENT DOCUMENTS

| | | | |
|---|---|---|---|
| 169207 | 9/1984 | Japan | 343/700 MS |
| 1192001 | 11/1985 | U.S.S.R. | 333/116 |

*Primary Examiner*—Benny T. Lee

*Attorney, Agent, or Firm*—Robert A. Westerlund; Steven M. Mitchell; Wanda K. Denson-Low

[57] ABSTRACT

An antenna system for an array antenna includes an array of radiators formed as patch antenna elements on a dielectric substrate, there being a shielding metallic sheet on a side of the substrate opposite the radiators. A further dielectric substrate and a bottom metallic sheet are disposed on a side of the shielding sheet opposite the radiators. An antenna feed system is disposed in the further sheet. Coupling devices such as orthogonal slots, in one embodiment, or a microwave crossover in a second embodiment, couple electromagnetic power from the feed system to the radiators through the shielding sheet. In the case of the coupling slots, the feed system provides phase quadrature signals for development of circularly polarized radiation. The crossover provides only a linearly polarized wave, and is formed of two coplanar waveguides, one in the shielding sheet and one in the bottom sheet. Each of the coplanar waveguides includes a pair of coupling pads, the pads of one waveguide being in registration with the pads of the other waveguide.

6 Claims, 6 Drawing Sheets

PLURAL LAYER CO-PLANAR WAVEGUIDE COUPLING SYSTEM FOR FEEDING A PATCH RADIATOR ARRAY

BACKGROUND OF THE INVENTION

This invention relates to waveguides, including coplanar waveguides, formed within electrically-conductive sheets disposed on opposite surfaces of a dielectric substrate and, more particularly, to a system for coupling electromagnetic power to antenna radiators formed within a conductive sheet, the power being coupled from beneath the sheet to avoid the presence of coupling elements within a path of radiation transmission.

Circuit boards comprising a dielectric substrate with opposed surfaces covered by metallic, electrically-conductive sheets are often used for construction of waveguides for conducting electromagnetic power among electronic components, such as radiators of an antenna, filters, phase shifters, and other signal processing elements.

There are three forms of such circuit boards. One form, known as stripline, comprises a laminated structure of three electrically conductive sheet spaced apart by two dielectric substrates. The middle sheet is etched to form strip conductors which cooperate with the outer sheets, which serve as ground planes, to transmit a TEM (transverse electromagnetic) wave. A second form of the circuit board, known as microstrip, is also provided as a laminated structure, but is simpler than the stripline in that there are only two sheets of electrically conductive material, the two sheets being spaced apart by a single dielectric substrate. One of the sheets is etched to provide strip conductors which in cooperation with the other sheet, which serves as a ground plane, supports a TEM wave. The third form of circuit board is provided with a coplanar waveguide, and comprises two sheets of electrically conductive material spaced apart by a dielectric substrate. The coplanar waveguide is formed completely within one of the sheets and is constructed as a pair of parallel slots etched within a conductive sheet, the two slots defining a central strip conductor. The central strip conductor cooperates with outer edges of the slot to support a TEM wave.

The microstrip and the coplanar waveguide structures are of particular interest herein because of their utility in interconnecting microwave components by use of a circuit board, which may be employed to support these components. Also, their relatively simple structure of a single dielectric layer, or substrate, with covering of metallic sheet permits interconnection with a variety of physical shapes of electronic components, particularly for the excitation of radiators of an array antenna. This permits greater flexibility in the layout of the components on a circuit board.

In the use of the circuit boards, it is frequently necessary to couple a portion of the power from one waveguide to another waveguide for combining signals such as, for example, in the case of a Butler matrix for distributing electromagnetic signals among elements of a phased array antenna. The capability for coupling electromagnetic signals between waveguides is particularly important in situations wherein power is to be coupled through a circuit board between a waveguide on one side to a circuit component, such as an antenna element, on the opposite side of the board. Heretofore, such coupling has been accomplished by use of a feed-through connector with appropriate impedance matching structures. Alternatively, power has been coupled to antenna elements by coupling elements which are located within the radiating aperture of an antenna element with adverse influence on the radiation pattern.

A problem arises in the deployment of coupling elements within the radiating aperture of an antenna element in that the design of the antenna element is made more complex by the need to diminish any adverse effects on the radiation pattern due to the presence of a coupling element in front of the radiating element. A problem also arises in the use of a feed-through connector for energizing an antenna element from behind the element in that additional manufacturing steps are required. For example, a microstrip waveguide and a coplanar waveguide can be manufactured by photolithography including an etching of the waveguide structure in a metallic sheet. In order to provide the feed-through connector, it is necessary to drill a hole through the dielectric substrate, and then to establish an electrically conducting path through the drilled hole. In addition, a feed-through connector may also entail the use of additional impedance-matching structures to avoid unwanted reflections from a discontinuity in the waveguide presented by the feed-through connector.

SUMMARY OF THE INVENTION

The foregoing problems are overcome and other advantages are provided by a coupling system employing microstrip or coplanar waveguides to energize radiators of an array antenna from beneath the surface of the antenna, which antenna is formed within the metallic sheet of a circuit board. By applying electromagnetic power from beneath the antenna, a more accurately defined antenna radiation pattern is produced. Also, the coupling system of the invention provides for the radiation of electromagnetic power through a dielectric substrate of a circuit board without the need for feed-through connectors. This facilitates the manufacturing process.

In the case of coplanar waveguide, a composite coupling structure, which may be referred to as a crossover, is provided for coupling all of the power from a metallic sheet on one side of the circuit board to a metallic sheet on the opposite side of the circuit board. The crossover employs two hybrid couplers connected in tandem, each of the hybrid couplers radiating one-half of the power through the dielectric substrate of the circuit board. Each of the hybrid couplers comprise two coplanar waveguides, one disposed in each of the metallic sheets of the circuit board. In each of the hybrid couplers, the central strip conductor of each waveguide is enlarged to form coupling pads, the pads of the two waveguides being in registration with each other.

Coupling to an antenna element, which antenna element is constructed as a "patch" type of radiator, is accomplished by mounting the patch radiator or antenna element above the microstrip or coplanar waveguide by a dielectric spacing layer. Coupling from a microstrip waveguide is accomplished by means of aperture slots in the intervening ground plane supported by dielectric material between the waveguide and the radiator. In the case of the coplanar waveguide, a resonator, in the form of a pad, is formed on the same sheet as an output terminal of the crossover, and beneath an edge of the antenna radiator for applying power to the radiator.

BRIEF DESCRIPTION OF THE DRAWING

The aforementioned aspects and other features of the invention are explained in the following description, taken in connection with the accompanying drawing wherein.

DETAILED DESCRIPTION

Figure 1:
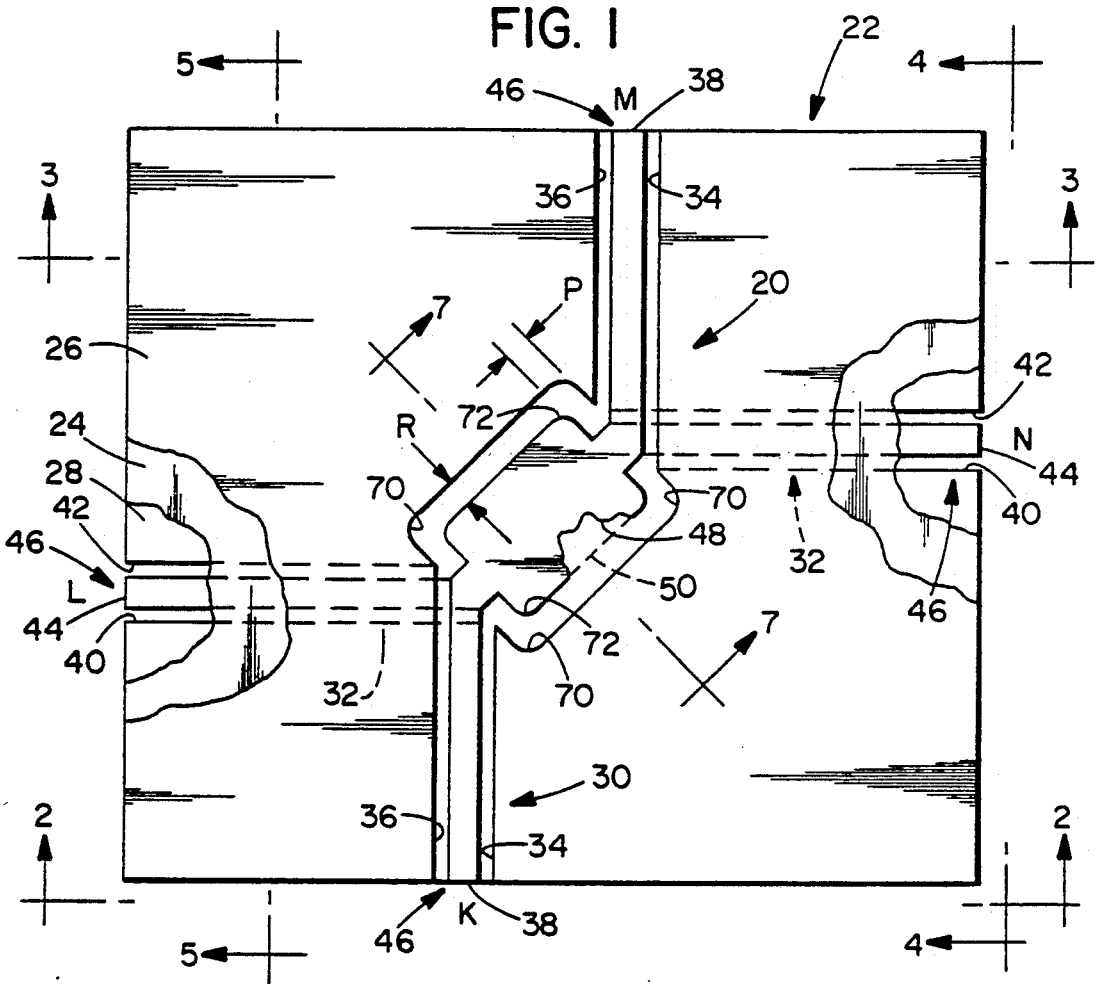
FIG. 1 is a plan view of a circuit board incorporating the hybrid coupler of the invention.
Figure 2:
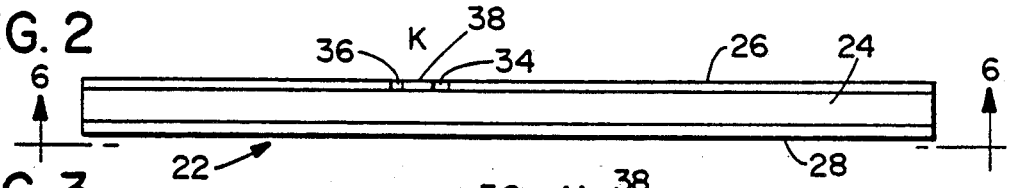
FIG. 2 is a side elevation view of the circuit board taken along the line 2—2 of FIG. 1.
Figure 3:
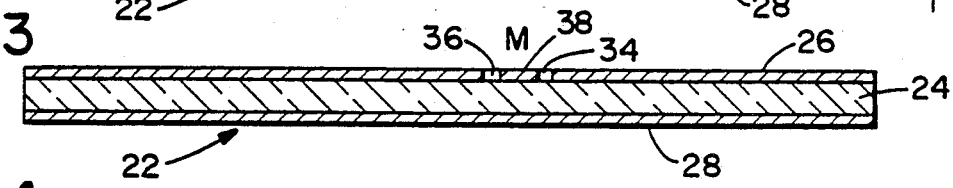
FIG. 3 is a sectional view of the circuit board, taken along the line 3—3 in FIG. 1.
Figure 4:
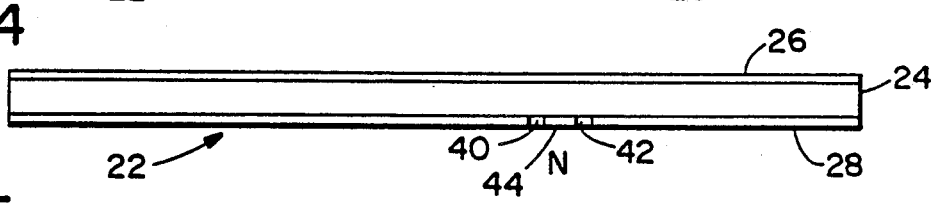
FIG. 4 is a side elevation view of the circuit board, taken along the line 4—4 in FIG. 1.
Figure 5:
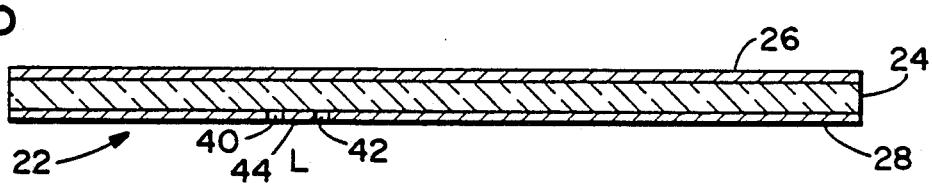
FIG. 5 is a sectional view of the circuit board, taken along the line 5—5 in FIG. 1.

In the practice of the invention, microwave power is coupled from a microstrip transmission line structure, or from a coplanar waveguide structure to a microstrip patch radiator of an array antenna. In the case of the microstrip transmission line, the microstrip transmission line structure takes the form of either a hybrid coupler or a power divider. In the case of the coplanar waveguide transmission line, the coplanar waveguide structure takes the form of a composite coupling structure employing two hybrid couplers in tandem. Before describing the foregoing three modes of coupling electromagnetic power to a microstrip patch antenna radiator, a description will be provided first for the construction of a coupler of microwave energy between coplanar waveguides on opposite surfaces of a circuit board, this being followed by a description of a tandem connection of two such couplers to produce the composite coupling structure, or crossover, of coplanar waveguides. Thereafter, the three embodiments of the coupling system of the invention will be described.

With reference to FIGS. 1–7, a coplanar waveguide microwave coupler 20 of the invention is constructed on a circuit board 22. The board 22 comprises a dielectric, electrically-insulating substrate 24, and top and bottom metallic, electrically-conductive sheets 26 and 28 disposed respectively on top and bottom surfaces of the substrate 24. The substrate 24 may be formed of a blend of glass fibers and a fluorinated hydrocarbon, such as Teflon, providing a dielectric constant of approximately 2.2. Typically, the metal used in the construction of the sheets 26 and 28 is copper. The terms "top" and "bottom" facilitate description of the invention by relating the orientation of the circuit board components to the arrangement shown in the drawing, and are not intended to describe the actual orientation of a physical embodiment of the circuit board which, in practice, may be oriented on its side or upside down.

Coplanar waveguide transmission lines, namely, coplanar waveguides 30 and 32 are respectively within the top and bottom sheets 26 & 28. Each of the coplanar waveguides 30 and 32 is formed by photolithographic techniques employing an etching of a pair of slots to define a strip conductor. In the coplanar waveguide 30, slots 34 and 36 define a strip conductor 38. In the coplanar waveguide 32, slots 40 and 42 define a strip conductor 44. The slots 34 and 36 in the coplanar waveguide 30, and the slots 40 and 42 in the coplanar waveguide 32 are spaced relatively close together and are parallel to each other to define ports 46 of the coupler 20. Individual ones of the ports 46 are identified further by the legends K, L, M, and N. At the coupler 20, the spacing between the slots 34 and 36 is enlarged to form a top pad 48 in the top sheet 26. Similarly, at the coupler 20, the spacing between the slots 40 and 42 is enlarged to form a bottom pad 50 in the bottom sheet 28. The widths of the slots 34 and 36 are increased at the periphery of the pad 48 so as to retain the same ratio between slot width and strip conductor width at the pad 48 as at the ports 46, thereby to retain the same characteristic impedance of the coplanar waveguide 30 at the pad 48. Similarly, the slots 40 ]nd 42 are enlarged at the periphery of the bottom pad 50 to retain the same ratio of slot width to strip conductor width at the pad 50 as at the ports 46 to retain the same value of characteristic impedance of the coplanar waveguide 32 at the pad 50.

Figure 8:
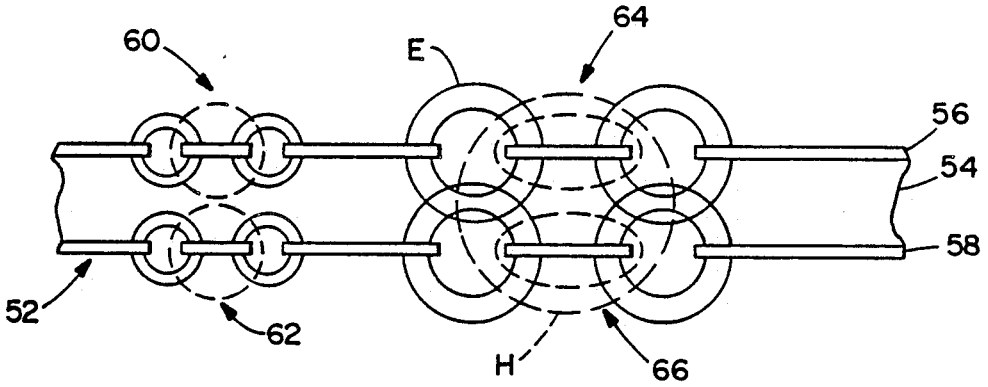
FIG. 8 is a schematic drawing of coplanar waveguides of differing dimensions to demonstrate coupling between coplanar waveguides on opposite sides of a circuit board.

FIG. 8 is a diagrammatic representation of an end view of a circuit board 52 having the same configuration as the circuit board 22 (FIG. 1), and being formed of a dielectric substrate 54 clad on top and bottom surfaces with metallic sheets 56 and 58. Four transmission lines in the form of coplanar waveguides 60, 62, 64 and 66 are shown on the board 52. The coplanar waveguides 60 and 62 have a relatively narrow cross-section, and are disposed respectively in the top and the bottom sheets 56 and 58. The two coplanar waveguides 64 and 66 are of relatively broad cross-sectional dimensions, and are disposed, respectively, in the top and the bottom sheets 56 and 58. An electromagnetic wave is shown propagating in each of the coplanar waveguides 60–66, the electromagnetic waves being indicated by an electric field E, portrayed as a solid line, and a magnetic field H, portrayed by a dashed line. In the narrow configuration of the coplanar waveguide 60 and 62, the fringing fields are retained close to the coplanar waveguide, while in the wider coplanar waveguides 64 and 66, the fringing fields extend further into the substrate 54 so as to allow for circulation of the magnetic field about the center strip conductors of the two coplanar waveguides 64 and 66. By analogy with the coupler 20 of FIG. 1, the narrow coplanar waveguides 60 and 62 represent the configurations of either of the coplanar waveguides 30 and 32 at a port 46. The widened configuration of the coplanar waveguides 64 and 66 represent the widened portions of the coplanar waveguides 30 and 32 at the pads 48 and 50. Thereby, it may be appreciated that the construction of the pads 48 and 50 introduces a significant increase in the amount of coupling between the coplanar waveguides 30 and 32.

Furthermore, as a further feature of the invention (FIGS. 1 and 6), in order to reduce coupling between the coplanar waveguides 30 and 32 at a distance from the coupler 20, the coplanar waveguides 30 and 32 are angled away from a center line 68 (FIG. 6) of the pads 48 and 50 to increase the distance between the coplanar waveguides 30 and 32. A typical value of the angulation is 45 degrees. The electrical length of each of the pads 48 and 50 is approximately one-quarter wavelength, namely the guide wavelength, as measured along the center line 68, of the electromagnetic radiation propagating along the coplanar waveguides 30 and 32. The width of each of the pads 48 and 50 is less than the length of the pads. The pads are shown as rectangular in shape with the corners of the pads being rounded, and similarly the contiguous portions of the slots 34, 36, 40, and 42 may have rounded corners, if desired, to minimize refections of electromagnetic signals propagating in the coplanar waveguides 30 and 32. The maintenance of a constant characteristic impedance throughout the coplanar waveguide 30 and its pad 48, as well as throughout the coplanar waveguide 32 and its pad 50, ensure a smooth flow of power with no more than a negligible amount of reflected power.

In the operation of the coupler 20, electromagnetic signals entering the coupler 20 via port K propagate past the pad 48 wherein a portion of the signal power is coupled out, the remaining portion of the signal continuing through the coupler 20 to exit by the port M. The portion of the signal coupled by the coupler 20 exits via the port L. The port N is an isolation port for signals entering via port K. It is noted that the construction of the coupler 20 is symmetrical, and that the transmission characteristics are reciprocal so that any one of the four ports 46 may serve as an input port.

An embodiment of the microwave coupler 20 has been constructed to operate at a frequency of 3 GHz (gigahertz). In this embodiment of the invention, the board 22 of FIG. 1 has a square shape and measures 2.5 inches on a side. The top and bottom sheets 26 and 28 are each made of copper to a thickness of 3 mils. The characteristic impedance of the coplanar waveguides 30 and 32 is 50 ohms. The dielectric constant of the substrate 24 is 2.2. At a −3 dB coupling ratio, the bandwidth is greater than 10 percent. The width of each slot 34, 36, 40 and 42 is 20 mils at the sites of the ports 46, and is enlarged to a width of 85 mils, dimension P, at the ends of the pads 48 and 50. The slot widths are widened to 71 mils, dimension R , at the sides of the pads 48 and 50. The width of each of the pads 48 and 50 is 306 mils. The length of each of the pads 48 and 50 is 684 mils. The width of each of the strip conductors 38 and 44 is 240 mils. The four outer corners 70 of the circumferential slot about the pads 48 and 50 are rounded to a radius of 250 mils. The four outer corners 72 of the pads 48 and 50 are rounded with a radius of 64 mils. The substrate 24 has a thickness of 58 mils. If desired, the bandwidth can be decreased by raising the dielectric constant of the substrate 24 as by use of alumina, for example.

The foregoing construction of the coupler 20 provides a desired capability for coupling a desired fraction of input electromagnetic power from a transmission line on one side of a circuit board to a transmission line on the opposite side of the circuit board. The electrical characteristics of the coupler 20 are that of a quadrature hybrid coupler wherein power inputted at port K is outputted partly at port M with essentially zero phase shift and partly at port L with a phase shift of −90 degrees. Essentially no power is outputted at port N; however, in the event that there were reflection at a load coupled to port L, such reflected power would exit partly at port N with the balance exiting at port K.

Figure 6:
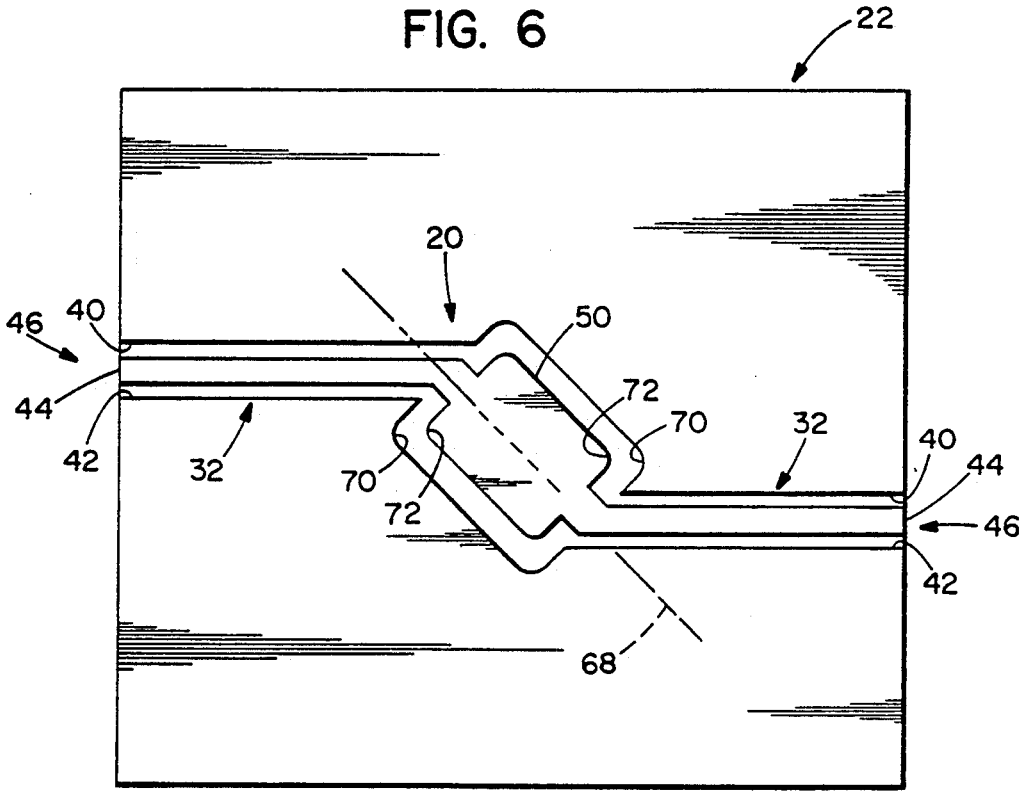
FIG. 6 is a plan view of the reverse side of the circuit board, taken along the line 6—6 in FIG. 2.
Figure 7:
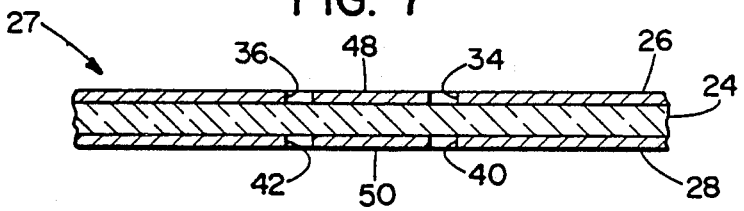
FIG. 7 is a fragmentary sectional view of the circuit board, taken along the line 7—7 in FIG. 1.
Figure 9:
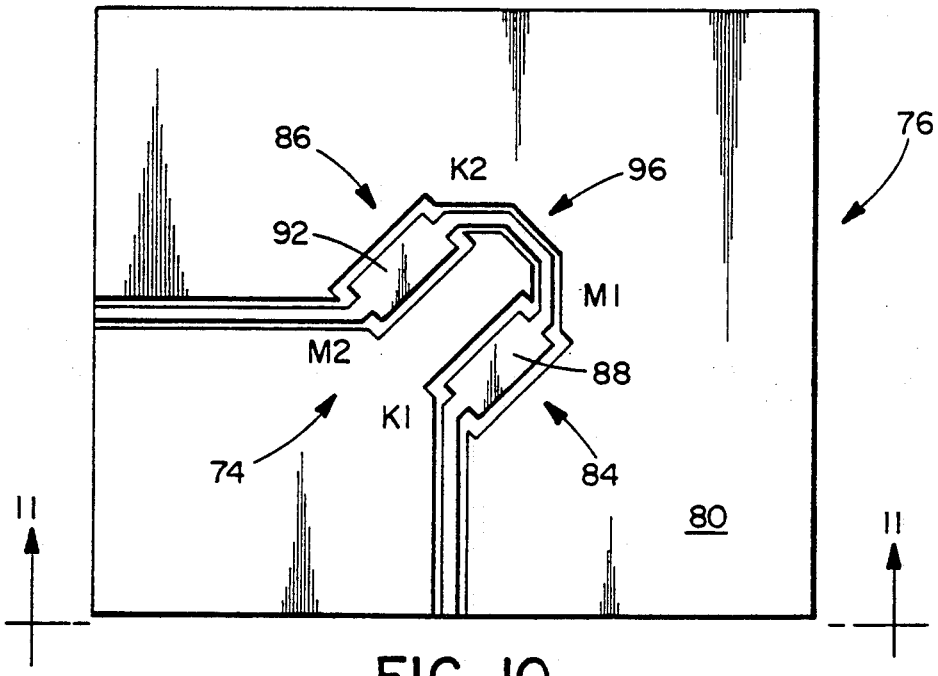
FIG. 9 is a plan view of a composite coupling structure, or crossover, comprising a tandem coupling of two hybrid couplers constructed in accordance with FIG. 1.
Figure 10:
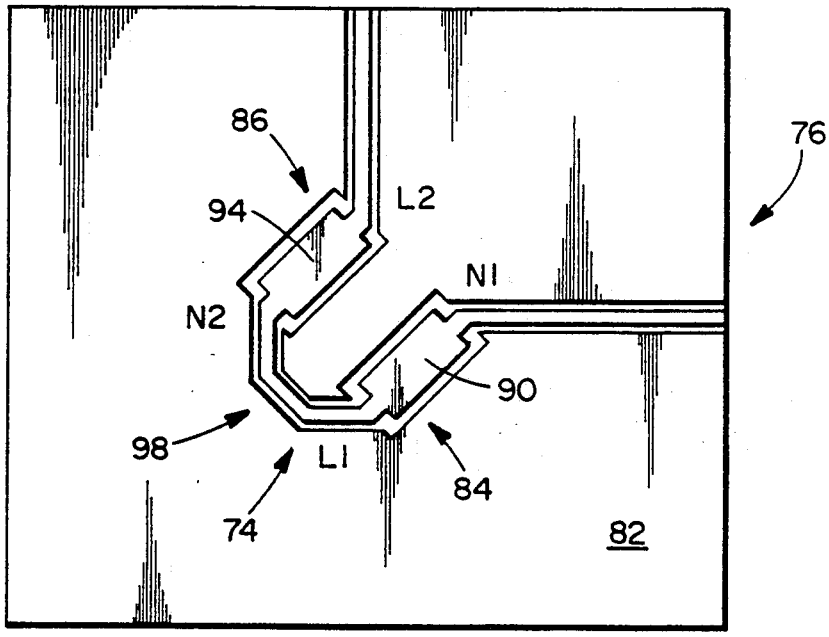
FIG. 10 is a plan view of a bottom layer of the crossover of FIG. 9.
Figure 11:
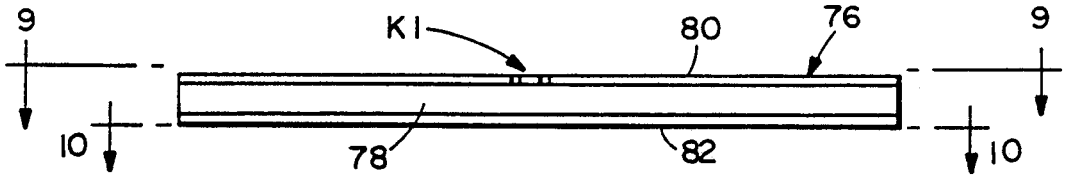
FIG. 11 is an end view, taken along the line 11—11 in FIG. 9, of the crossover of FIG. 9, FIG. 11 showing the directions of viewing the presentations of FIGS. 9 and 10 via lines 9—9 and 10—10, respectively.

A feature of the invention is the use of a pair of the couplers 20 in the construction of a microwave crossover circuit. With reference to FIGS. 9, 10, and 11 there is shown a crossover 74 for electromagnetic signals providing for a crossing of essentially all of the power in an electromagnetic signal from a transmission line in a top sheet of a circuit board, through a dielectric substrate of the circuit board, and into a transmission line in a bottom sheet of the circuit board. The crossover 74 is formed as a composite of two microwave couplers, such as that described in FIGS. 1–8, connected in tandem, the resulting microwave structure having two input ports and two output ports. Upon comparing FIGS. 9 and 10 with FIGS. 1 and 6, similar microwave structures are noted, the microwave structure of FIGS. 9 and 10 employing two of the microwave structures of FIGS. 1 and 6. In FIGS. 1 and 9, both of the views are taken in the same direction, namely, looking down upon the microwave structure. In FIGS. 6 and 10, the views are reversed wherein the view in FIG. 10 is taken looking down upon a bottom metallic sheet while in FIG. 6 the view is taken looking up at the bottom metallic sheet. Thus, the presentation of the microwave structure of FIG. 6 is reversed from the presentation of the corresponding structure in FIG. 10. The crossover 74 is described now in detail.

The crossover 74 is formed on a circuit board 76 comprising an electrically-insulating, dielectric 78 clad on its top and bottom surfaces respectively with a top metallic sheet 80 and a bottom metallic sheet 82. The materials used in the construction of the substrate 78, and the sheets 80 and 82 are the same as those disclosed for the structure of FIG. 1. The crossover 74 comprises two microwave quadrature hybrid couplers 84 and 86, each of which has the same construction as was disclosed for the coupler 20 of FIG. 1. The couplers 84 and 86 are connected in tandem. To facilitate a description of the interconnection of the couplers 84 and 86, the four ports of each of the couplers 84 and 86 are identified individually corresponding to the identification of the ports in FIG. 1. The ports of the coupler 84 are identified by the legends K1, L1, M1 and N1. The ports of the coupler 86 are identified by the legends K2, L2, M2 and N2.

The ports K1 and N1 serve also as input ports to the crossover 74. The ports M2 and L2 serve also as output ports of the crossover 74. The coupler 84 comprises a top pad 88 in the top sheet 80, and a bottom pad 90 in the bottom sheet 82. The coupler 86 comprises a top pad 92 in the top sheet 80, and a bottom pad 94 in the bottom sheet 82. The pads 88 and 92 are connected by ports M1 and K2 and a length of transmission line formed as a coplanar waveguide 96 within the top sheet 80. The pads 90 and 94 are connected by the ports L1 and N2 and a length of transmission line formed as coplanar waveguide 98 within the bottom sheet 82. The transmission lines have a characteristic impedance of 50 ohms, or other value as may be required to facilitate connection to circuits outside the crossover.

Figure 12:
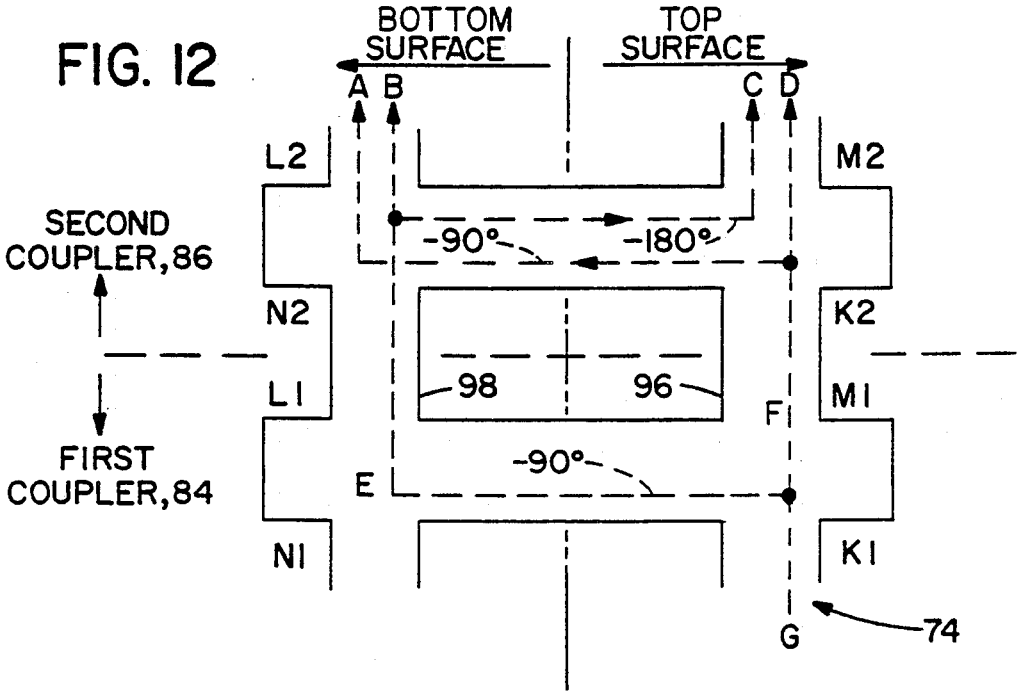
FIG. 12 is a diagrammatic representation of the crossover useful in explaining the transfer of power from a top metallic sheet to a bottom metallic sheet of the crossover.

FIG. 12 is useful in explaining the operation of the crossover 74. In FIG. 12, portions of the couplers 84 and 86 of the crossover 74 are represented diagrammatically by rectangular blocks which are interconnected schematically by transmission lines for the transmittal of electromagnetic signals within the couplers 84 and 86 and between ports of the couplers 84 and 86. As was noted above, the port K1 and N1 serve as the input ports, and the port M2 and L2 serve as the output ports. The structure of the crossover 74 operates in reciprocal fashion so that the two output ports may be employed as input ports in which case the ports K1 and N1 would output the signal. In the explanation of operation based on FIG. 12, it is presumed that the input ports are K1 and N1 FIG. 12 is divided by a horizontal dashed line into an upper portion and a lower portion, the lower portion representing the first coupler 84, and the upper portion representing the second coupler 86 FIG. 12 is also divided by a vertical dashed line into a right half and a left half, the right half representing transmission line structure at the top surface within the sheet 80 of the crossover 74. The left side of FIG. 12 represents transmission line structure in the bottom surface, within the sheet 82 of the crossover 74.

In this explanation of the operation, it is presumed that a wave enters the input port K1 at point G, and propagates along paths indicated by dashed lines. Key points on the dashed lines are indicated at E and F in the coupler 84, and four waves resulting by operation of the couplers 84 and 86 appear at points A, B, C, and D at the two output ports L2 and M2 of the crossover 74.

In operation, the input wave at G splits at the coupler 84 into two waves E and F having equal power, which power is equal to one-half of the original power at G. The wave at E is shifted 90 degrees lagging relative to the wave at F. At the coupler 86, the wave E splits into two components B and C having equal power, the power in the wave components B and C each being equal to one-quarter of the input power at G. Similarly, the wave at F is split by the coupler 86 into two wave components A and D having equal power, the power in each of the waves A and D being equal to one-quarter of the power at G. The wave at C is shifted in phase by a lagging 90 degrees relative to the wave at B. Similarly, the wave at A is shifted in phase by a lagging 90 degrees relative to the wave at D. As a result of the phase shifting, the wave component at C has undergone two ninety-degree phase shifts for a total phase shift of −180 degrees. Therefore, the wave component C destructively interferes with the wave component D resulting in a cancellation of all power outputted at the output port M2. Therefore, none of the power of the wave at E is coupled from the left side of the coupler 86 to the right side of the coupler 86; all of the power at E exits the output port L2. Similarly, none of the power at F exits the output port M2, all of the power being coupled from the right side of the coupler 86 to the left side of the coupler 86 to exit at the output port L2.

Since the coupling of power via the couplers 84 and 86 each introduce a lagging phase shift of 90 degrees, the contributions via both couplers 84 and 86 are in phase at the output port L2, the two contributions at A and B each having a lagging phase shift of 90 degrees. The relationship can also be expressed mathematically by noting that the signal strength is proportional to the square root of the power. Since the signals at A and B each have a power equal to one-quarter of the input power, the amplitudes of the signals at A and B are each equal to one-half of the input signal amplitude. Since the summation of the amplitudes of the cophasal signals at A and B is equal to the amplitude of the input signal, it is apparent that all of the input power exits the port L2. By similar mathematical reasoning, The signals at C and D, which also have one-quarter of the input power, have signal amplitudes equal to one-half of the input signal amplitude. The signals at C and D, being out of phase with each other, cancel so that no signal exits the port M2. Thus, the two contributions at A and B add cophasally to produce an output power at the output port L2 equal to the power inputted at the input port K1. The wave outputted at the output port L2 has a lagging phase of 90 degrees relative to the phase of the wave inputted at the input port K1. In similar fashion, a signal inputted at the port N1 crosses over through the circuit board 76 to exit at the port M2.

Figure 13:
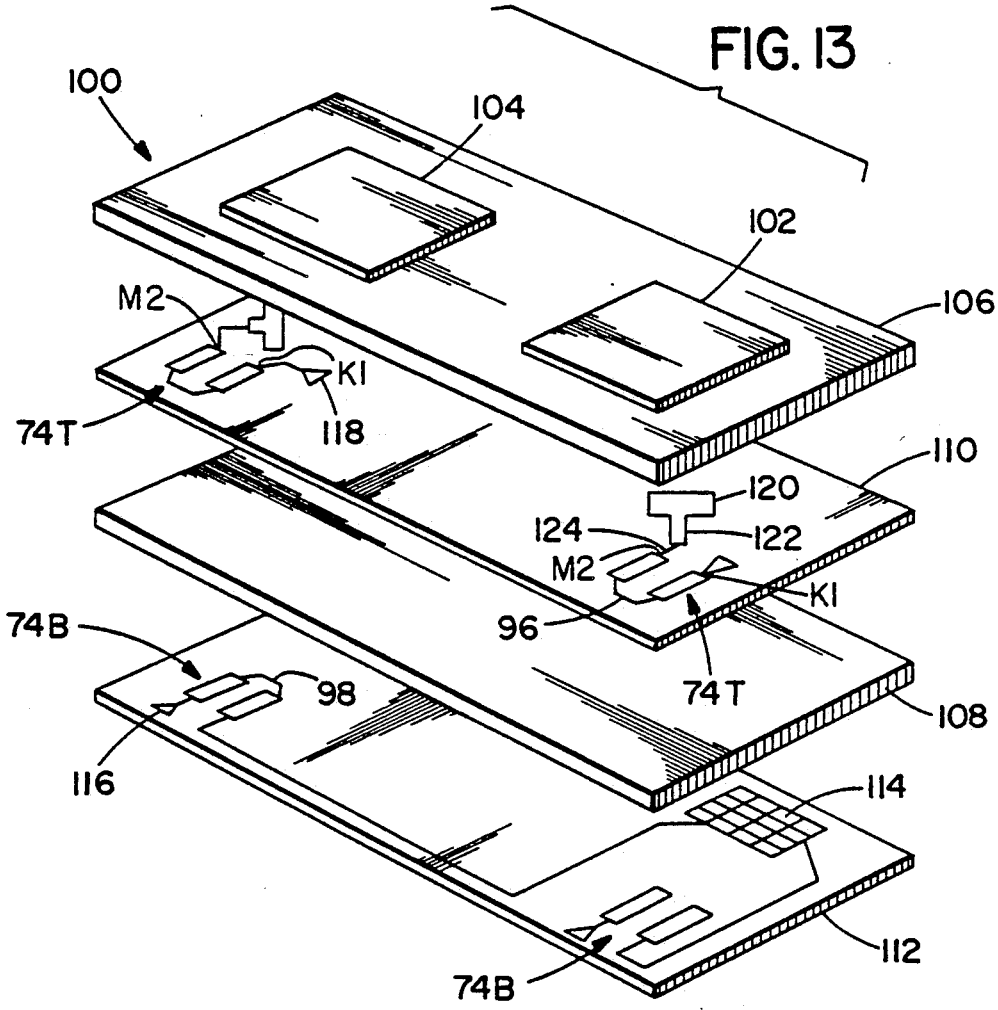
FIG. 13 is an exploded stylized view showing the activation of an antenna radiator by use of the crossover of FIG. 9.

FIG. 13 shows an antenna system 100 formed of a multiple layer circuit board fabricated originally of three metallic sheets, namely a top sheet, a middle sheet and a bottom sheet, spaced apart by top and bottom dielectric substrates. The top sheet has been etched to form an array of radiators of which two radiators 102 and 104 are shown supported on the top substrate 106. The second of the substrates is shown as a bottom substrate 108.

The middle metallic sheet 110 is disposed between the top substrate 106 and the bottom substrate 108. The bottom metallic sheet 112 is disposed on the bottom surface of the substrate 108. Also included within the bottom sheet 112 is a power distribution network 114 such as a Butler matrix or power divider circuit.

A feature of the invention is the coupling of power from the distribution network 114 to the microstrip patch antenna radiators 102 and 104 by means of crossovers 74, each crossover 74 being constructed as described in FIGS. 9–12. In the exploded view of FIG. 13, a top portion of the crossover 74 comprising the pads 88 and 92 (FIG. 9) is formed within the middle sheet 110, the top portion of the crossover 74 being indicated in FIG. 13 by the legend 74T. The bottom portion of each crossover 74 comprising the pads 90 and 94 (FIG. 10) is formed in the bottom sheet 112 in FIG. 13, the bottom portion of a crossover 74 being indicated by the legend 74B in FIG. 13. To simplify the presentation in FIG. 13, the crossover portions 74T and 74B are indicated symbolically by a pair of rectangles joined by their respective transmission lines 96 and 98. In each of the crossovers 74, terminal N1 of the lower portions 74B is connected to the distribution network 114, and the output port L2 of the bottom portion 74B is terminated in a matched load 116. In the top portion 74T of each crossover, the port K1 is terminated with a matched load 118, and the output port M2 is connected to a resonator 120.

Figure 14:
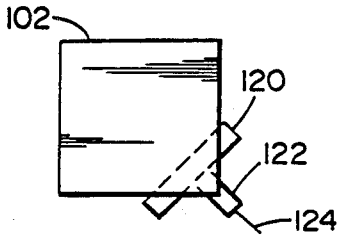
FIG. 14 is a diaqrammatic plan view of a radiator of FIG. 13 showing emplacement of a resonator in alignment with a diagonal of the radiator.

Each resonator 120 has a rectangular shape and includes a central tab extending from a long side of the resonator 120 toward a crossover 74 for connection therewith. The length of a resonator 120 is approximately one-half wavelength. One of the resonators 120 extends beneath the radiator 102 and the other of the resonators 120 extends beneath the radiator 104. With respect to the radiator 102, the resonator 120 is aligned with a diagonal of the radiator 102, as shown in FIG. 14, the radiator 102 having a square shape. In FIG. 14, most of the resonator 120 is hidden beneath the radiator 102, the tab 122 of the resonator 120 and a transmission line 124 for connection with a crossover 74 extending beyond the perimeter of the radiator 102. Electromagnetic power is coupled from the resonator 120 to the radiator 102. The antenna system 100 is reciprocal in operation so that radiation incident upon the radiator 102 is coupled to the resonator 120, and via the crossover portion 74T to the distribution network 114. The amount of coupling between the resonator 120 and the radiator 102 can be adjusted by extension or retraction of the resonator 120 along the diagonal of the radiator 102. The foregoing description of the radiator 102 with its resonator 120 applies also to the radiator 104 with its resonator 120.

Figure 15:
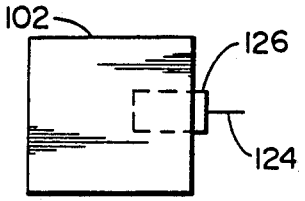
FIG. 15 is a diagrammatic plan view of a radiator of FIG. 13 showing an alternative arrangement of a coupling resonator disposed beneath an edge of the radiator.

If desired, the resonator 120 may be replaced with a coupling element 126 as shown in FIG. 15. The coupling element 126 extends beneath an edge of the radiator 102 rather than along a diagonal as was disclosed in FIG. 14. The amount of coupling can be adjusted by extension or retraction of the coupling element 126 relative to the radiator 102. With both the embodiments of FIGS. 14 and 15, the radiator 102 is energized for transmission of radiation having a single direction of linear polarization. If desired, different ones of the radiators of the antenna system 100 may be energized to radiate in different directions. This is demonstrated in FIG. 13 by the orientation of the resonator 120 beneath the radiator 104 in a direction perpendicular to the orientation of the resonator 120 beneath the radiator 102.

With respect to the reception of incident radiation, the arrangement of FIG. 15 provides for reception of radiation having only a predetermined direction of polarization. In the case of the embodiment of FIG. 14, due to the angulation of the resonator 120 relative to the sides of the radiator 102, the resonator 120 can couple received radiation polarized along any edge of the radiator 102, as well as radiation wherein the electric field vector rotates as in circular polarization.

Figure 16:
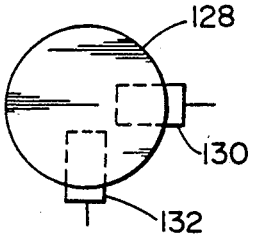
FIG. 16 is a diagrammatic plan view of a circular radiator which may be employed in the system of FIG. 13, FIG. 16 demonstrating the use of two orthogonally positioned resonators for coupling power in either of two polarizations.

In FIG. 16, the microstrip patch antenna radiator 102 has been replaced with a circular microstrip patch antenna radiator 128 activated by two orthogonally disposed coupling elements 130 and 132. Each of the coupling elements 130 and 132 may be connected via separate crossovers 74 to different terminals of the distribution network 114 so as to allow for excitation of the radiator 120 in either of two orthogonal directions of polarization By energizing the coupling elements 130 and 132 with electromagnetic signals in phase quadrature, circularly polarized radiation can be transmitted and received.

In accordance with a feature of the invention, the construction of the antenna system 100 allows for activation of the radiators 102 and 104 by microwave circuitry disposed beneath the radiators 102 and 104. This arrangement of the microwave circuitry beneath or behind the radiators allows the radiators to transmit and receive electromagnetic signals without interference from the microwave circuitry coupled to the radiators. Thereby, a beam of radiation can be provided with an accurately defined radiation pattern. It is noted further that the radiators 102 and 104 are constructed in the form known as microstrip patch antenna elements, and may have any desired shape, yet still be coupled to the microwave circuitry beneath the radiators for successful transmission and reception of electromagnetic signals.

Figure 17:
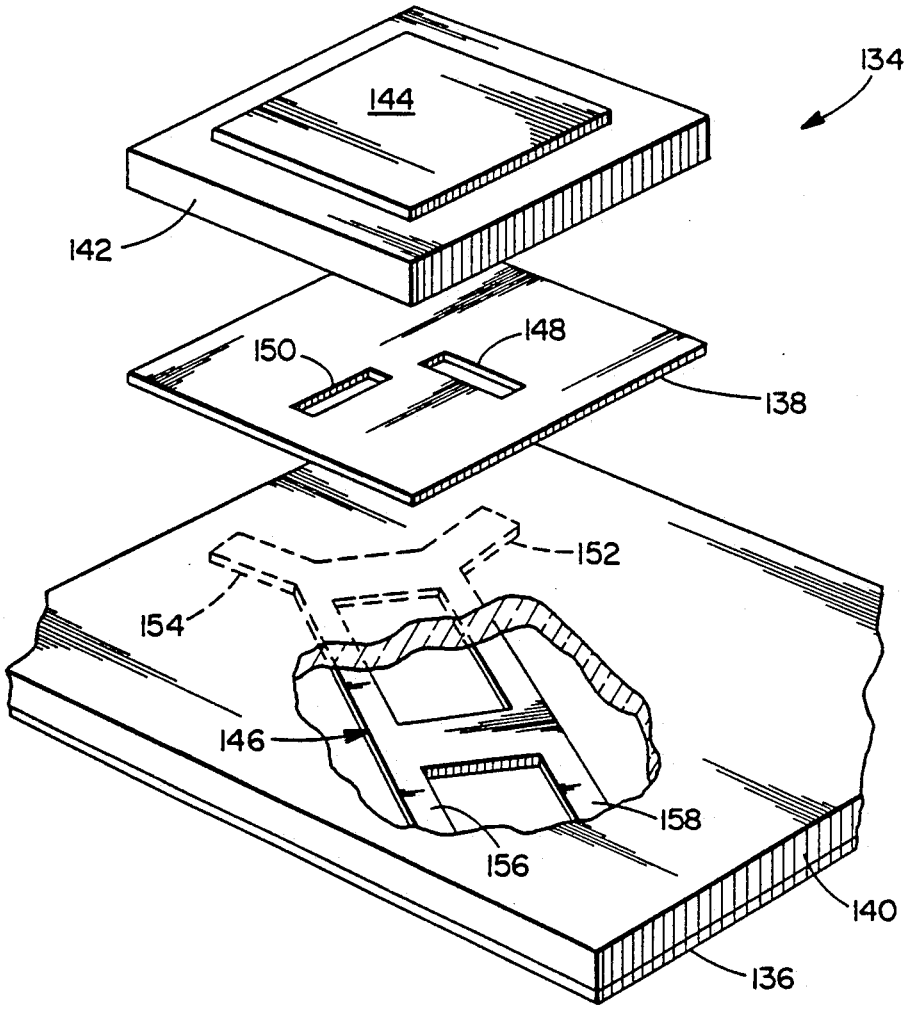
FIG. 17 is an exploded stylized view showing the use of a microstrip hybrid coupler for applying power to an antenna patch radiator.

FIG. 17 shows an alternative embodiment of the invention wherein an antenna system 134 is formed of a multiple layer circuit board which, as shown in exploded view, comprises a bottom metallic sheet 136 and a middle metallic sheet 138 which are secured in spaced apart relation by a bottom dielectric substrate 140. A substrate 142 is disposed above the middle sheet 138. A top metallic sheet, originally forming a part of the circuit board, has been etched away to leave a patch antenna radiator 144 disposed on a top surface of the substrate 142.

The embodiment of FIG. 17 has an advantage not found in the embodiment of FIG. 13. In FIG. 13, the coupling of electromagnetic signals through a dielectric substrate by use of the crossover 74 is restricted to the transmission of radiation with a single direction of polarization for each crossover 74 employed. However, in the embodiment of FIG. 17, a single microwave coupling circuit can apply electromagnetic signals through a dielectric substrate to the radiator 144 while providing for circularly polarized radiation. This is accomplished by use of a microstrip quadrature hybrid coupler 146 formed within the bottom sheet 136, and which radiates electromagnetic signals which are coupled via a pair of perpendicular slot apertures 148 and 150 to excite radiation from the microstrip patch antenna radiator 144. It is to be understood that the radiator 144 may be one of many such radiators in an array antenna, and that for each of these radiators, a separate hybrid coupler 146, and a separate pair of perpendicular slot apertures in the intervening ground plane would be employed.

The coupler 146 comprises two open-ended sections of microstrip transmission lines which may be referred to as feeds 152 and 154 extending beneath and perpendicularly to the slot aperatures 148 and 150, respectively. A portion of the substrate 140 has been cut away to disclose the coupler 146.

Figure 18:
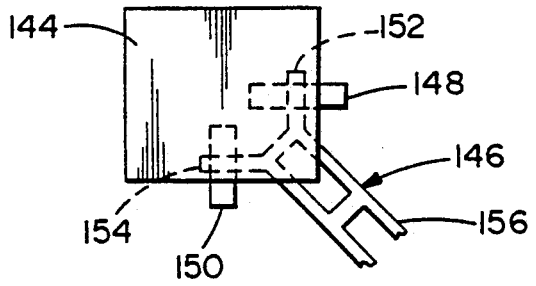
FIG. 18 is a diagrammatic plan view of a radiator of FIG. 17 showing the registration of components of a feed structure with the radiator.

With reference also to FIG. 18, the plan view shows the locations of the microstrip feeds 152 and 154, and the slot apertures 148 and 150 relative to the radiator 144. A signal entering one of the arms of the microstrip coupler 146, such as at the microstrip arm 156, splits evenly between the feeds 152 and 154, the signal in the feed 152 lagging the signal in the feed 154 by 90 degrees. The perpendicular orientation of the feeds 152 and 154 relative to their respective slot apertures 148 and 150 are oriented relative to the edges of the radiator 144, such that the long side of a slot is perpendicular to an edge of the radiator. This orientation provides for coupling of the electromagnetic fields of the slot apertures to the radiators. In this way, the slot apertures 148 and 150 act as a transformer for converting the electric and magnetic field distribution surrounding each of the feeds 152 and 154 into a field distribution which can be coupled to the radiator 144. A matched load (not shown) may be connected to the microstrip arm 158 of the coupler 146 for receiving any reflections of signals from the radiator 144. The middle sheet 138 is the ground plane for both the microstrip coupler 146 and the radiator 144 and other radiators (not shown) of the antenna system 134. The phase quadrature relationship of the signals induced in the slot apertures 148 and 150, in cooperation with the perpendicular orientation of the slot apertures 148 and 150 induce a circularly polarized radiation from the microstrip patch antenna radiator 144.

The antenna system 134 of FIG. 17 is particularly advantageous for application to millimeter wave monolithic phased arrays. In this situation, associated active elements, such as phase shifters and amplifiers, together with the microstrip hybrid coupler 146 may be formed on a substrate of gallium arsenide which has a high dielectric constant, approximately 12.8, the gallium arsenide having also other important electrical performance advantages which result in a reduction of the physical size of the coupler 146 by a factor proportional to the reciprocal of the square root of the dielectric constant. In the case of the gallium arsenide, the size reduction is by a factor of 3.58.

Antenna elements, such as the radiator 144, may be mounted, preferably, on a substrate of low dielectric constant, such as a blend of glass fibers and a fluorinated hydrocarbon, which substrates are available commercially under the name Duroid. The lower dielectric-constant, approximately 2.2, provides for increased bandwidth, increased radiation efficiency, and a larger angle of scan for a phased array antenna without an occurrence of scan blindness. In the embodiment of FIG. 17, the circularly polarized antenna elements are located on a separate substrate, this arrangement yielding optimal array performance while eliminating the problem of insufficient space, found in previous antenna designs, between the antenna elements and the feed network. In addition to serving as an intervening ground plane, the middle sheet 138 also shields the antenna half-space (the region of space in front of the middle sheet 138 into which the antenna radiates) from spurious radiation emitted by feed lines and active devices, such as the circuitry of the coupler 146 and active elements (not shown) which may be mounted on the bottom substrate 140.

It is also noted that the use of the aperture coupling, provided by the slot apertures 148 and 150 obviates problems associated with probe-type feeds of prior antenna systems at millimeter wave frequencies. These problems appear as a complexity of construction and excessive self reactances of the probes. The absence of such probes in the antenna design of FIG. 17 eliminates such problems of previous antenna systems.

Figure 19:
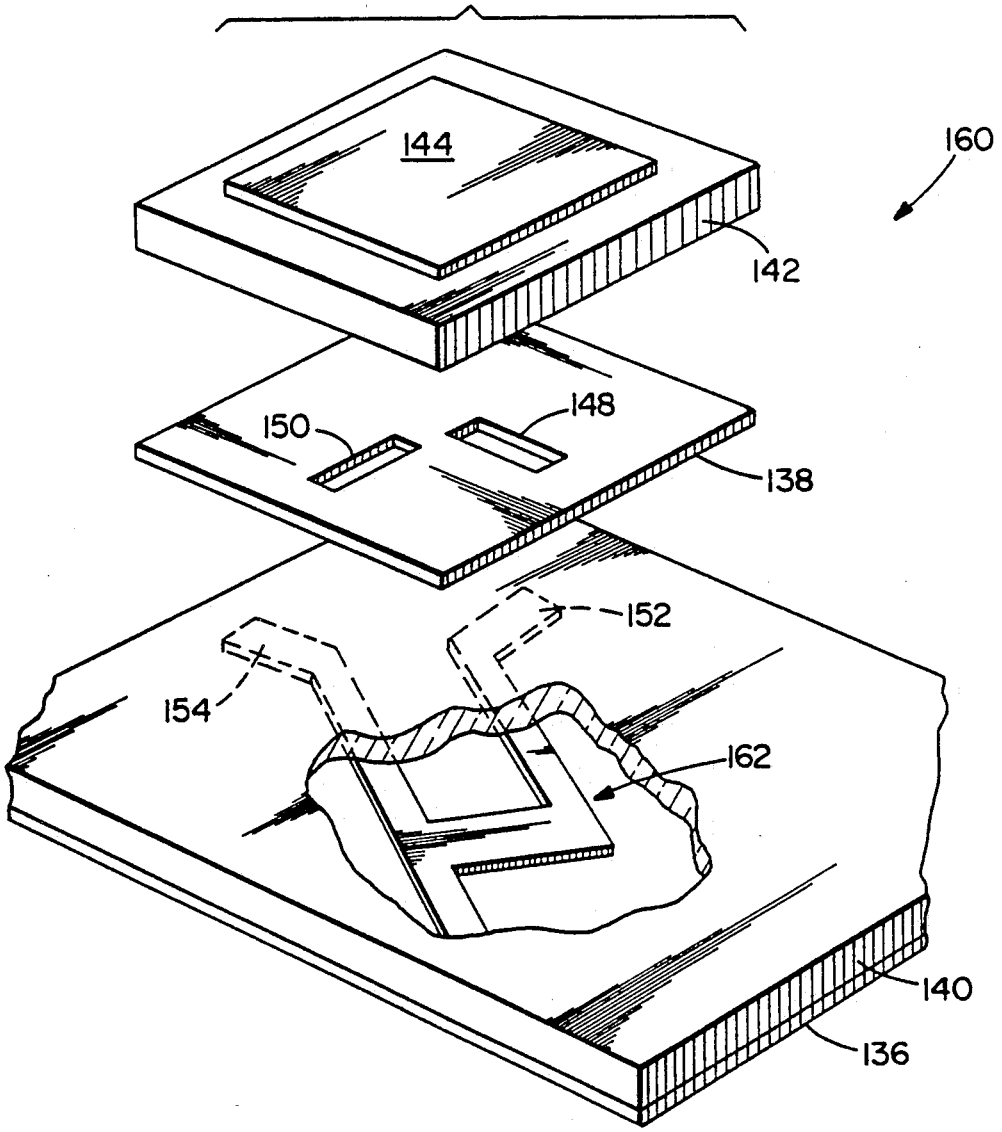
FIG. 19 is an exploded stylized view of a microstrip power divider employed for activating a patch radiator of an antenna.

With reference to FIG. 19, there is shown an antenna system 160 which has the same configuration as the antenna system 134 of FIG. 17, but with the difference that the coupler 146 (FIG. 17) is replaced with a microstrip power divider 162 in FIG. 19. The microstrip power divider 162 is constructed with unequal lengths of transmission line to obtain the requisite 90 degree phase shift at microstrip feeds 152 and 154 connected to output ports of the microstrip power divider 162. While the power divider provides for circularly polarized radiation in the system 160 of FIG. 19, the direction of rotation of the electric vector is in one sense only. In contrast, use of the coupler 146 of FIG. 17, which coupler has two input signal arms 156 and 158, affords the benefit of a selection of sense of rotation of the electric field vector. The direction of rotation is selected by inputting a signal at either the arm 156 or 158. This selection is unavailable in the system 160 of FIG. 19 because the power divider 162 has but one input port. The power divider 162 offers the advantage of saving space in those situations in which the saving of space is more important than the ability to select the rotational direction of the circular polarization.

Each of the foregoing embodiments of the invention have provided for an antenna structure in which all of the feed lines, and other circuit elements may be placed behind radiating elements of the antenna so as to facilitate manufacture and improve radiation characteristics.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. An antenna system comprising:

a first electrically-conductive sheet;

a second electrically-conductive sheet;

means for supporting said second sheet parallel to said first sheet and spaced apart therefrom;

an array of radiators;

means for positioning said array of radiators in spaced-apart relation from said second sheet, said second sheet being located between said radiators and said first sheet;

a plurality of crossovers for transferring electromagnetic power from said first sheet to said second sheet, wherein each of said crossovers comprises a first coupler and a second coupler, each of said couplers comprising:

a first coplanar transmission line disposed in said first sheet, a portion of said first transmission line being formed as a first coupling pad;

a second coplanar transmission line disposed in said second sheet, a portion of said second transmission line being formed as a second coupling pad, and wherein each of said transmission lines has a first end and a second end, and each of said transmission lines is a coplanar waveguide formed as a pair of slots within a corresponding conductive sheet, the pair of slots being spaced apart to define a central strip conductor therebetween;

a plurality of coupling elements disposed within said second sheet and connected to corresponding ones of said crossovers for coupling electromagnetic power between said corresponding ones of said crossovers and respective ones of said radiators;

power distribution means disposed at least in part on said first sheet and connected to each of said crossovers, said second sheet shielding said radiators from said power distribution means;

in each of said transmission lines, said coupling pad is formed as a widened portion of the strip conductor, and each slot has a widened portion contiguous the pad;

in each of said couplers, said first pad is disposed in corresponding registration with said second pad for coupling electromagnetic power betweeen said first and said second transmission lines;

each of said pads has a first and a second end, and extends in a longitudinal direction along a corresponding transmission line from the first end of the pad to the second end of the pad, and each of said pads has opposed sides extending in the longitudinal direction from the first end of the pad to the second end of the pad, the sides and the ends of said first pad being in registration with the sides and the ends respectively of said second pad;

said first end of said first transmission line of said first coupler serves as an input port of said crossover and is connected to said power distribution means;

said first end of said second transmission line of said first coupler is terminated in a matched load;

said second end of said first transmission line of said first coupler is connected to said first end of said first transmission line of said second coupler;

said second end of said second transmission line of said first coupler is connected to said first end of said second transmission line of said second coupler;

said second end of said first transmission line of said second coupler is terminated in a matched load; and said second end of said second transmission line of said second coupler serves as an output port of said crossover, and is connected to a corresponding coupling element for transferring power from said distribution means past said second sheet to a corresponding radiator of said array of radiators.

2. An antenna system according to claim 1 wherein said supporting means is a substrate of dielectric material disposed between said first sheet and said second sheet, and said positioning means is a substrate of dielectric material disposed between said second sheet and said radiators.

3. An antenna system according to claim 2 wherein each of said couplers is a quadrature hybrid coupler and each of said coupling elements is a resonator.

4. An antenna system comprising:

a first electrically-conductive sheet;

a second electrically-conductive sheet;

means for supporting said second sheet parallel to said first sheet and spaced apart therefrom;

an array of radiators;

means for positioning said array of radiators in spaced-apart relation from said second sheet, said second sheet being located between said radiators and said first sheet;

a plurality of crossovers for transferring electromagnetic power from said first sheet to said second sheet, wherein each of said crossovers comprises:

a first coplanar transmission line disposed in said first sheet, a first portion of said first transmission line being formed as a first coupling pad and a second portion of said first transmission line being formed as a second coupling pad;

a second coplanar transmission line disposed in said second sheet, a first portion of said second transmission line being formed as a third coupling pad and a second portion of said second transmission line being formed as a fourth coupling pad; and wherein each of said transmission lines is a coplanar waveguide formed as a pair of slots within a corresponding conductive sheet, the pair of slots being spaced apart to define a central strip conductor therebetween;

a plurality of coupling elements disposed within said second sheet and connected to corresponding ones of said crossovers for coupling electromagnetic power between said corresponding ones of said crossovers and respective ones of said radiators;

power distribution means disposed at least in part on said first sheet and connected to each of said crossovers, said second sheet shielding said radiators from said power distribution means;

in each of said transmission lines, each of said coupling pads is formed as a widened portion of the central strip conductor, and each slot ha a widened portion contiguous each pad;

said first pad is disposed in registration with said third pad and said second pad is disposed in registration with said fourth pad for coupling electromagnetic power between said first and said second transmission lines;

each of said pads has a first and a second end, and extends in a longitudinal direction along a corresponding transmission line from the first end of the pad to the second end of the pad, each of said pads has opposed sides extending in the longitudinal direction from the first end of the pad to the second end of the pad, the sides and the ends of said first pad being in registration with the sides and the ends respectively of said third pad, the sides and the ends of said second pad being in registration with the sides and the ends respectively of said fourth pad;

an end of said first transmission line extending from said first pad serves as an input pot of said crossover and is connected to said power distribution means;

an end of said first transmission line extending from said second pad is terminated in a matched load;

an end of said second transmission line extending from said third pad is terminated in a matched load;

an end of said second transmission line extending from said fourth pad serves as an output port of said crossover and is connected to a corresponding coupling element for transferring power from said distribution means past said second sheet to a radiator.

5. An antenna system according to claim 4 wherein said supporting means is a first substrate of dielectric material disposed between said first sheet and said second sheet, and said positioning means is a second substrate of dielectric material disposed between said second sheet and said radiators.

6. An antenna system according to claim 5 wherein each of said radiators is a patch antenna element formed as a metallic layer upon said second substrate, and each of said coupling elements is a resonator.

* * * * *